US011075052B2

(12) United States Patent
Freudenberger et al.

(10) Patent No.: US 11,075,052 B2
(45) Date of Patent: Jul. 27, 2021

(54) X-RAY DEVICE AND METHOD OF APPLYING X-RAY RADIATION

(71) Applicant: Siemens Healthcare GmbH, Erlangen (DE)

(72) Inventors: Jörg Freudenberger, Kalchreuth (DE); Anja Fritzler, Erlangen (DE); Peter Geithner, Erlangen (DE); Peter Hackenschmied, Nuremberg (DE); Thomas Weber, Hausen (DE)

(73) Assignee: Siemens Healthcare GmbH, Erlangen (DE)

( * ) Notice: Subject to any disclaimer, the term of this patent is extended or adjusted under 35 U.S.C. 154(b) by 108 days.

(21) Appl. No.: 16/585,156

(22) Filed: Sep. 27, 2019

(65) Prior Publication Data

US 2020/0187339 A1 Jun. 11, 2020

Related U.S. Application Data

(60) Provisional application No. 62/777,043, filed on Dec. 7, 2018.

(30) Foreign Application Priority Data

Sep. 6, 2019 (EP) ..... 19195781

(51) Int. Cl.
*H01J 35/08* (2006.01)
*H01J 35/10* (2006.01)
(Continued)

(52) U.S. Cl.
CPC ..... *H01J 35/116* (2019.05); *H01J 35/105* (2013.01); *H05G 1/025* (2013.01); *H05G 1/04* (2013.01);
(Continued)

(58) Field of Classification Search
CPC ..... H01J 2235/08; H01J 2235/1204; H01J 35/105; H01J 2235/1295; H01J 35/10; H01J 35/116; H05G 1/025; H05G 1/04
See application file for complete search history.

(56) References Cited

U.S. PATENT DOCUMENTS 3,867,637 A 2/1975 Braun
3,983,397 A 9/1976 Albert
(Continued)

FOREIGN PATENT DOCUMENTS

CN 2242521 Y * 12/1996
CN 206002466 U 3/2017
(Continued)

OTHER PUBLICATIONS

European Search Report for European Application No. 19195781.0-1212 dated Apr. 23, 2020.
(Continued)

*Primary Examiner* — Chih-Cheng Kao
(74) *Attorney, Agent, or Firm* — Lempia Summerfield Katz LLC

(57) ABSTRACT

The present disclosure provides an x-ray device including a housing configured to provide a vacuum therein, a cathode arranged inside the housing and configured to emit electrons, an anode arranged inside the housing and configured to produce x-ray radiation when impacted by electrons emitted by the cathode, and a converter configured to convert the x-ray radiation produced by the anode into monochromatic x-ray radiation, wherein the anode is configured to produce x-ray radiation in transmission and is arranged between the cathode and the converter. The present disclosure may be used in medical imaging, therapy, spectroscopy, and the like. Geometries and configurations may be improved compared to previously known x-ray devices when it comes to requirements for space, materials used,
(Continued)

complexity of electrical wiring, distance between cathode and anode, and providing supplementary functions.

16 Claims, 6 Drawing Sheets

(51) Int. Cl.
*H05G 1/02* (2006.01)
*H05G 1/04* (2006.01)

(52) U.S. Cl.
CPC ... *H01J 2235/08* (2013.01); *H01J 2235/1204* (2013.01); *H01J 2235/1295* (2013.01)

(56) References Cited

U.S. PATENT DOCUMENTS

| | | | | |
|---|---|---|---|---|
| 4,382,181 | A | 5/1983 | Wang | |
| 6,041,095 | A | 3/2000 | Yokhin | |
| 6,295,338 | B1 * | 9/2001 | Kuzniar | H01J 35/107 378/132 |
| 9,326,744 | B2 | 5/2016 | Silver | |
| 2008/0084966 | A1 * | 4/2008 | Aoki | H01J 35/24 378/140 |
| 2018/0333591 | A1 | 11/2018 | Silver | |
| 2020/0182806 | A1 | 6/2020 | Kappler | |

FOREIGN PATENT DOCUMENTS

| | | | |
|---|---|---|---|
| DE | 19639241 | C2 | 7/1998 |
| JP | 2008084853 | A | 4/2008 |
| JP | 2009054562 | A | 3/2009 |

OTHER PUBLICATIONS

Jacobson, Bertil, and Lars Nordberg. "X-Ray Tube with a Built-In Secondary Target for Exciting K Lines." Review of Scientific Instruments 34.4 (1963): 383-385.

Tan, Dagang. "A novel X-ray source for diagnosis: K-fluorescent enhanced X-ray tube." Proceedings of the 22nd Annual International Conference of the IEEE Engineering in Medicine and Biology Society (Cat. No. 00CH37143). vol. 4. IEEE, 2000. pp. 2506-2509.

Baldelli, P. et al., "Development of a quasi-monochromatic source for mammography applications," Nuclear Inst. and Methods in Physics Research, A; vol. 518, issue 1-2 (Frontier Detectors for Frontier Physics: Proceeding); pp. 386-388; 2004.

* cited by examiner

X-RAY DEVICE AND METHOD OF APPLYING X-RAY RADIATION

The present patent document claims the benefit of U.S. Provisional Patent Application No. 62/777,043, filed Dec. 7, 2018, which is hereby incorporated by reference in its entirety. The present patent document also claims the benefit of European Patent Application No. 19195781.0, filed Sep. 6, 2019, which is also hereby incorporated by reference.

TECHNICAL FIELD

The present application is directed to an x-ray device and a method of applying x-ray radiation.

BACKGROUND

X-ray radiation is being used in a multitude of applications, ranging from medical imaging or therapy or security checks at airports to crystallography. The most common devices for generating x-ray radiation are x-ray tubes, which are vacuum tubes in which electrons are emitted by a cathode and accelerated towards an anode, where the electrons produce x-ray radiations through bremsstrahlung or other physical processes. X-ray tubes are generally simpler in construction and use than other ways of producing x-ray radiation like for example synchrotron radiation generated in particle accelerators.

U.S. Patent Application Publication No. 2018/0333591 A1 describes such an x-ray device, which further includes a converter to transform polychromatic x-ray radiation produced by bremsstrahlung into characteristic monochromatic radiation, which is desirable in particular in medical applications as results may be obtain with lower radiation dosages. In said x-ray device and other similar x-ray devices, as described for example in German Patent DE 19 639 241 C2, the x-ray radiation has to be directed from the anode to the converter, which leads complex beamlines for the x-ray radiation traveling from the anode to the point of application.

This leads to generally small angles of incidence of the x-ray radiation and accompanying lowered intensity of radiation as well as heating of other components of the x-ray device by x-ray photons which are not directed towards the point of application.

SUMMARY AND DESCRIPTION

Against this background, an objective of the present disclosure is to simplify the beamlines of x-ray radiation in an x-ray device.

According to the present disclosure, this task is solved by an x-ray device and by a method of applying x-ray radiation.

The scope of the present disclosure is defined solely by the appended claims and is not affected to any degree by the statements within this summary. The present embodiments may obviate one or more of the drawbacks or limitations in the related art.

Consequently, an x-ray device is provided, which includes a housing configured to provide (or including) a vacuum therein, a cathode arranged inside the housing and configured to emit electrons, an anode arranged inside the housing and configured to produce x-ray radiation when impacted by electrons emitted by the cathode, and a converter configured to convert the x-ray radiation produced by the anode into monochromatic x-ray radiation. The anode is configured to produce x-ray radiation in transmission and is arranged between the cathode and the converter.

Furthermore, a method of applying x-ray radiation is provided. In this method electrons are emitted from a cathode. X-ray radiation is produced with an anode being impacted by the electrons emitted from the cathode, x-ray radiation produced by the anode is converted into monochromatic x-ray radiation with a converter, and the monochromatic x-ray radiation is applied. The anode is configured to produce x-ray radiation in transmission and is arranged between the cathode and the converter.

It is an idea of the present disclosure to combine an anode configured to produce x-ray radiation in transmission with converter for converting said x-ray radiation into monochromatic x-ray radiation. This greatly simplifies the beam path the x-ray radiation travels on from the anode to the region of application via the converter, compared to previously known x-ray devices. This simplified design further allows an improved provision of supplementary functions to the x-ray device, in particular an arrangement of ways for cooling the anode and/or the converter.

Advantageous configurations and further embodiments may be derived from the dependent claims as well as from the description with reference to the figures.

According to a further embodiment, the x-ray device includes a transmission body, wherein the transmission body includes a material transparent to x-ray radiation. Such a transmission body may be arranged as a way of dissipating heat away from the anode and/or the converter, advantageously prolonging the lifetime of the respective parts.

According to a further embodiment, the transmission body is arranged in contact with the anode. In that configuration, the transmission body may advantageously dissipate heat from the anode by heat conduction.

According to a further embodiment, the transmission body is arranged structurally separated from the converter. In that configuration, the converter may be easily exchangeable allowing improved advantageous adaptability of the x-ray device.

According to a further embodiment, the transmission body is arranged in contact with the converter. In that configuration, the transmission body may advantageously dissipate heat from the converter by heat conduction.

According to a further embodiment, the converter is arranged between the anode and the transmission body in contact with the anode and the transmission body. In that configuration, the transmission body may be formed especially large, advantageously improving its capacity to dissipate heat from both the anode and the converter by heat conduction.

According to a further embodiment, the x-ray device includes a cooling device configured to cool the converter. This allows even better dissipation of heat away from the converter, advantageously improving the lifetime of the converter.

According to a further embodiment, the converter is arranged inside the transmission body. In that configuration, the converter may be arranged especially close to the anode, advantageously increasing the amount of x-ray radiation produced by the anode converted into monochromatic x-ray radiation by the converter.

According to a further embodiment, the converter is arranged in a curved form such that at least one lateral edge of the converter is in contact with the anode. This advantageously increases the amount of x-ray radiation produced by the anode converted into monochromatic x-ray radiation by the converter even further.

According to a further embodiment, the x-ray device includes a cooling device configured to cool the transmission body. This allows even better dissipation of heat away from the transmission body, advantageously improving its capability of dissipating heat away from the anode and/or the converter.

According to further embodiment, the x-ray device includes a cooling device configured to cool the anode. This allows even better dissipation of heat away from the anode, advantageously improving the lifetime of the anode.

According to further embodiment, the anode, the converter and/or the transmission body are configured to be rotatable around an axis of rotation. Such a configuration enables a limitation of which parts of the respective components are heated during use of the x-ray device, which allows for an advantageously continuous dissipation of heat even when producing high intensities of x-ray radiation.

The above-mentioned configurations and further embodiments may be combined with each other, if it is reasonable. Further possible configurations, further embodiments and implementations of the disclosure also include combinations of features of the disclosure described before or in the following with regard to the examples of implementation not explicitly mentioned. In particular, the skilled person will also add individual aspects as improvements or additions to the respective fundamental form of the present disclosure.

BRIEF DESCRIPTION OF THE DRAWINGS

This disclosure is explained in more detail below using the examples given in the schematic illustrations.

The following figures are intended to convey a further understanding of the forms in which the disclosure is carried out. They illustrate embodiments and serve in connection with the description to explain principles and concepts of the disclosure. Other embodiments and many of the above-mentioned advantages may be derived from the drawings. The elements of the drawings are not necessarily shown to scale.

In the figures of the drawings, identical elements, characteristics and components with the same function and effect are provided with the same reference signs, unless otherwise specified.

DETAILED DESCRIPTION

Figure 1:
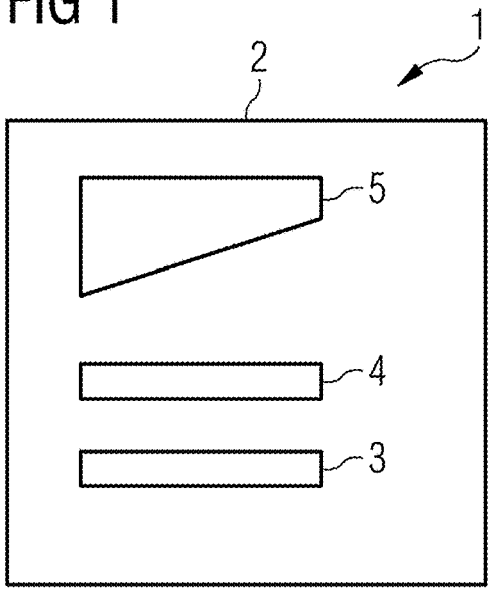
FIG. 1 depicts a schematic representation of an embodiment of an x-ray device.

FIG. 1 shows a schematic representation of an embodiment of an x-ray device 1. The x-ray device includes a housing 2, a cathode 3, an anode 4, and a converter 5. The housing 2 is airtight and configured to provide a vacuum therein. The cathode 3, the anode 4, and the converter 5 are arranged inside the housing 2. The anode 4 is arranged between the cathode 3 and the converter 5.

In use, the cathode 3 emits electrons into the vacuum inside the housing 2, for example, through the field emission effect, thermionic emission, or other well-known physical processes. Under effect of the electrical field between the cathode 3 and the anode 4, the electrons are accelerated towards the anode 4. Upon impacting on the anode 4, the electrons interact with the anode 4 and thereby produce x-ray radiation through bremsstrahlung, characteristic x-ray emission, or the like. The anode 4 is configured to produce x-ray radiation in transmission, which means that the produced x-ray radiation radiates onwards from the anode 4 in the direction of the converter 5. X-ray radiation impacting on the converter 5 is converted into monochromatic x-ray radiation, which in the embodiment shown in FIG. 1 radiates in a direction perpendicular to the direction of incident x-ray radiation produced by the anode 4.

As shown in FIG. 1, the combination of an anode 4 configured to produce x-ray radiation in transmission with a converter 5 allows for a very simple beam path of the x-ray radiation including only a single change in direction of the x-ray radiation. Furthermore, the converter 5 includes a simple shape in the form of a prism, which allows for easier production of the converter 5 compare to for example the truncated pyramid shape known from some already known x-ray devices.

Figure 2:
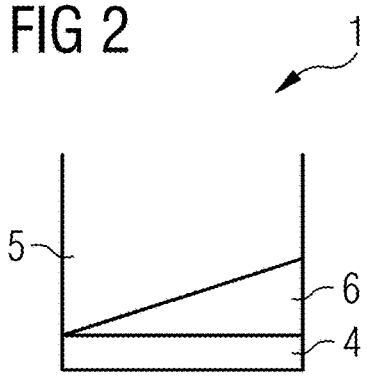
FIG. 2 depicts a schematic view of part of an embodiment of an x-ray device.

FIG. 2 shows a schematic through a part of a further embodiment of an x-ray device 1. FIG. 2 shows an anode 4 and a converter 5, which are essentially the same as those shown in FIG. 1, as well as a transmission body 6. The transmission body 6 includes a material transparent to x-ray radiation and includes a wedge-form. The transmission body 6 is arranged in contact with the anode 4 and the converter 5.

The x-ray device 1 functions essentially the same as the x-ray device 1 described in conjunction with FIG. 1. Furthermore, the arrangement of the transmission body 6 in contact with both the anode 4 and the converter 5 allows for improved dissipation of heat from the anode 4, which is heated by the electrons impacting thereon, and the converter 5, which is heated by the absorption of x-ray photons at energy levels above the energy of the emitted monochromatic x-ray radiation. As the transmission body 6 is transparent to x-ray radiation it is itself not substantially heated be the x-ray radiation passing there through.

Figure 3:
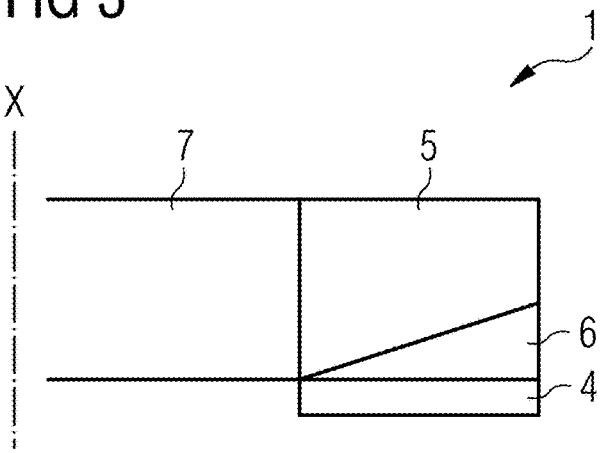
FIG. 3 depicts a schematic view of part of an embodiment of an x-ray device.

FIG. 3 shows a schematic view of a part of a further embodiment of an x-ray device 1. FIG. 3 shows an anode 4, a converter 5, and a transmission body 6, which are essentially the same as shown in FIG. 2. FIG. 3 further shows a heat conductor 7 arranged in contact with the converter 5. The heat conductor 7 is configured to be rotatable around an axis of rotation X, and the anode 4, the converter 5, and the transmission body 6 are configured to be rotatable along with the heat conductor 7. The anode 4, the converter 5, the transmission body 6, and the heat conductor 7 have a shape which is rotationally symmetrical around the axis of rotation X.

In use, the anode 4, the converter 5, the transmission body 6, and the heat conductor 7 rotate around the axis of rotation X. Therefore, only a part of the respective parts interacts with the electrons emitted by the cathode 3, which is not shown. As only the parts interacting with the electrons heat up, said heat may be continuously dissipated, which greatly increases the lifetime of the respective parts of the x-ray device.

Figure 4:
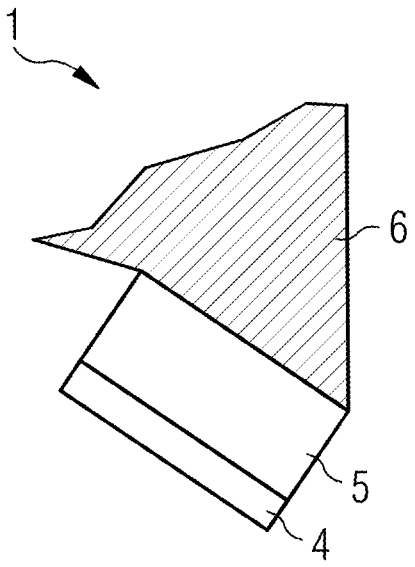
FIG. 4 depicts a schematic view of part of an embodiment of an x-ray device.

FIG. 4 shows a schematic view of a part of a further embodiment of an x-ray device 1. FIG. 4 shows an anode 4, a converter 5, and part of a transmission body 6. In the embodiment shown in FIG. 4, the converter 5 is arranged between and in contact with the anode 4 and the transmission body 6. The converter 5 is configured to convert x-ray radiation into monochromatic x-ray radiation in transmission, which means that the monochromatic x-ray radiation leaves the converter 5 on the opposite side of the x-ray radiation produced by the anode 4 entering the converter 5.

In the embodiment shown in FIG. 4, the transmission body 6 is formed larger than in the previously shown embodiments, which greatly enhances its capability for dissipating heat away from the anode 4 and the converter 5.

Figure 5:
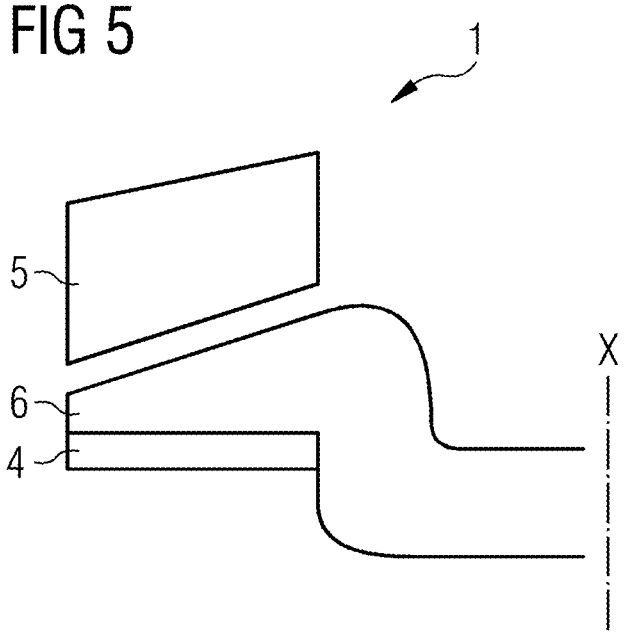
FIG. 5 depicts a schematic view of part of an embodiment of an x-ray device.

FIG. 5 shows a schematic view of a part of a further embodiment of an x-ray device 1. FIG. 5 shows an anode 4, a converter 5, and a transmission body 6. In the embodiment shown in FIG. 5, the transmission body 6 is arranged in contact with the anode 4 and is configured to be rotatable around an axis of rotation X. The anode 4 and the transmission body 6 are configured to be rotationally symmetrical around the axis of rotation X, providing the advantages described in conjuncture with FIG. 3.

The converter 5 is arranged separate from both the anode 4 and the transmission body 6. In this configuration, the converter 5 may be configured to be easily replaceable, which allows the x-ray device 1 to be configured to different intended purposes. For example, multiple converters may be arranged on a wheel and be exchanged by rotating said wheel.

Figure 6:
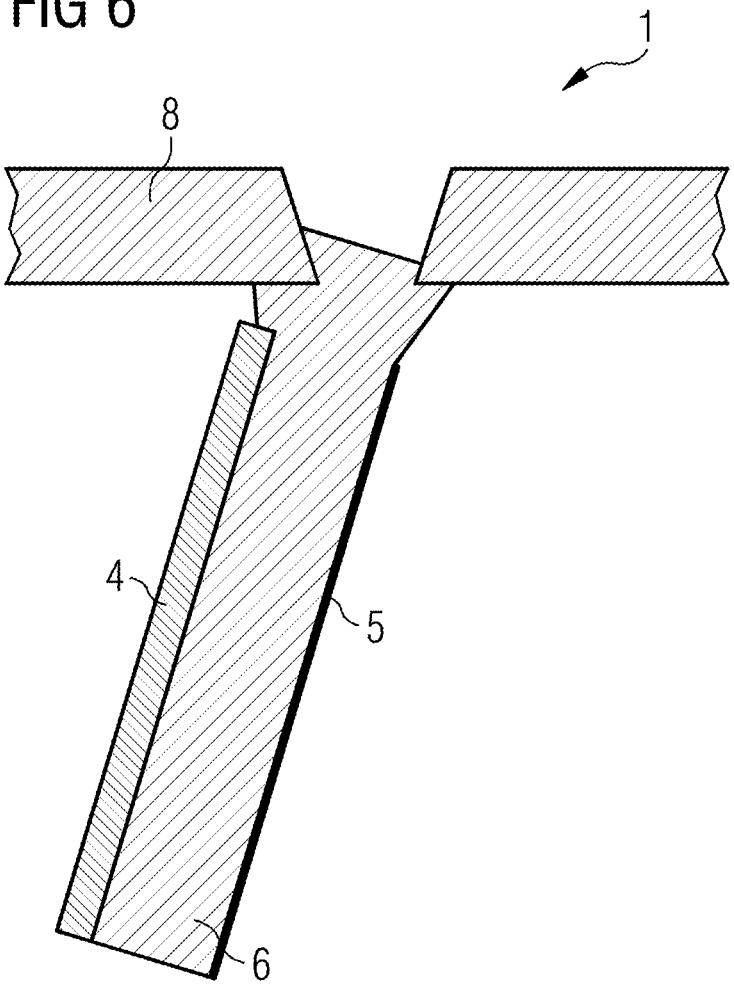
FIG. 6 depicts a schematic view of part of an embodiment of an x-ray device.

FIG. 6 shows a schematic view of a part of a further embodiment of an x-ray device 1. FIG. 6 shows an anode 4, a converter 5, and a transmission body 6. In the embodiment shown in FIG. 6, the anode 4, the converter 5, and the transmission body 6 each include a flat, plate-like shape, and the transmission body 6 is arranged between and in contact with the anode 4 and the converter 5. The embodiment shown in FIG. 6 exemplifies the simplicity of configuration of the parts or the x-ray device enabled by the combination of an anode 4 configured to produce x-ray radiation in transmission and a converter 5.

The x-ray device 1 shown in FIG. 6 further includes a collimator 8, configured to narrow the angle of monochromatic x-ray radiation traveling from the converter 5 to the point of application. The collimator 8 may be configured to be exchangeable.

In the perspective shown in FIG. 6, the electrons impact the anode 4 coming from the left and the monochromatic x-ray radiation emitted by the converter 5 mainly radiates in an upward direction through the collimator 8.

Figure 7:
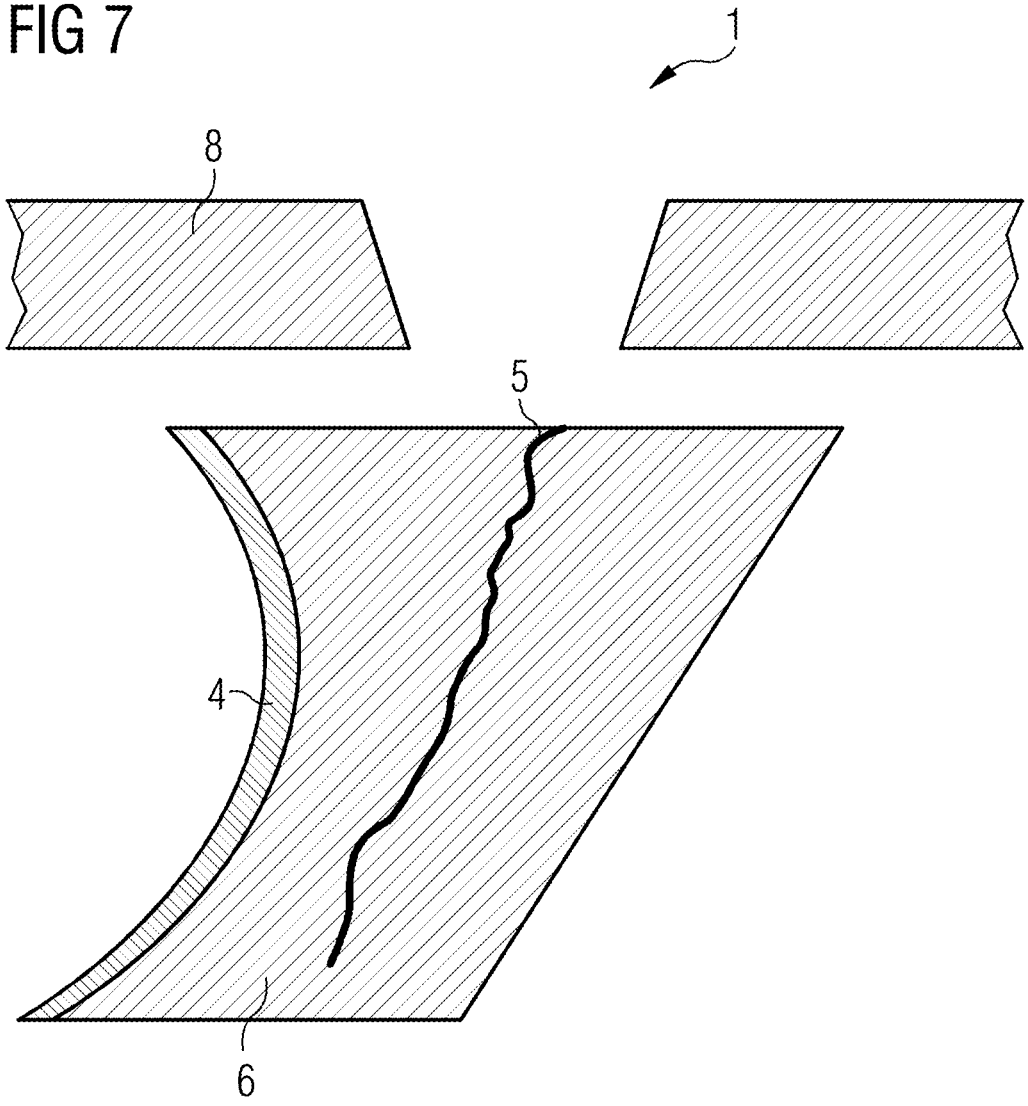
FIG. 7 depicts a schematic view of part of an embodiment of an x-ray device.

FIG. 7 shows a schematic view of a part of a further embodiment of an x-ray device 1. FIG. 7 shows an anode 4, a converter 5, a transmission body 6, and a collimator 8. The embodiment shown in FIG. 7 differs from the embodiment shown in FIG. 6 in that the converter 5 is configured to be a layer arranged inside the transmission body 6. In this configuration, the converter 5 may be arranged close to the anode 4, which increases the amount of x-ray radiation reaching the converter 5 from the anode 4 without being scattered.

Furthermore, the anode 4 shown in FIG. 7 includes a curved shape, which increases the surface impacted by electrons and consequently increases the amount of x-ray radiation produced by the anode 4.

The converter 5 shown in FIG. 7 is configured as one single layer. It is also possible to configure a converter 5 inside a transmission body 6 as including a plurality of parts. For example, a converter 5 in that sense may be configured to include a plurality of micro-particles distributed in the transmission body 6.

Figure 8:
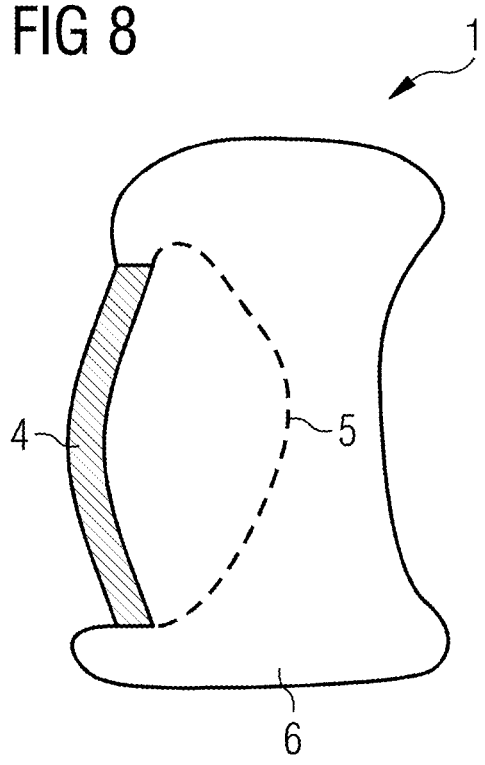
FIG. 8 depicts a schematic view of part of an embodiment of an x-ray device.

FIG. 8 shows a schematic view of a part of a further embodiment of an x-ray device 1. FIG. 8 shows an anode 4, a converter 5, and a transmission body 6. FIG. 8 shows a different perspective than the one shown in FIGS. 6 and 7. In the perspective of FIG. 8, the monochromatic x-ray radiation emitted by the converter 5 radiates towards the point of view. The layer including the converter 5 has a curved shape, with its lateral edges being arranged in contact with the anode 4. In this configuration, almost all of the x-ray radiation produced by the anode 4 reaches the converter 5 and is subsequently converted into monochromatic x-ray radiation.

Figure 9:
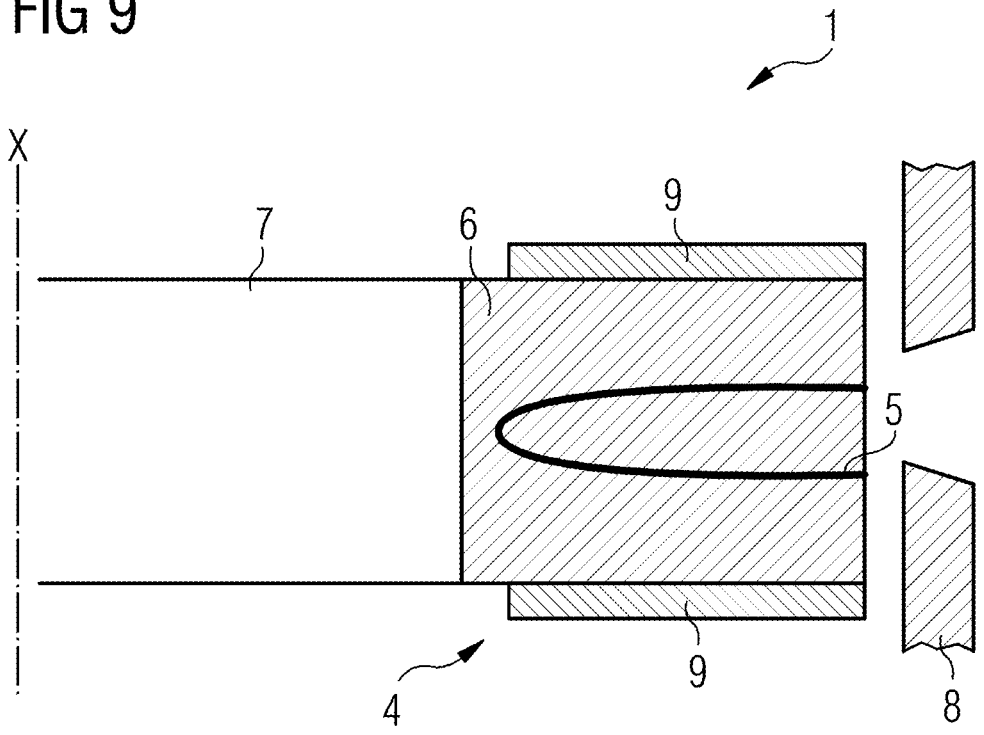
FIG. 9 depicts a schematic view of part of an embodiment of an x-ray device.

FIG. 9 shows a schematic view of a part of a further embodiment of an x-ray device 1. FIG. 9 shows an anode 4, a converter 5, a transmission body 6, and a collimator 8. In the embodiment shown in FIG. 9, the anode 4 includes two x-ray-active layers 9, which are arranged to be impacted by electrons coming from opposite sides. The transmission body 6 is arranged in between the two x-ray active layers 9, and the converter 5 is configured as a layer having a paraboloid shape arranged inside the transmission body 6. A heat conductor 7 is arranged in contact with the transmission body 6 and is configured to be rotatable around an axis of rotation X. The anode 4, the converter 5, and the transmission body 6 are configured to be rotatable along with the heat conductor and have a rotationally symmetrical shape forming a rotating anode configuration.

Figure 10:
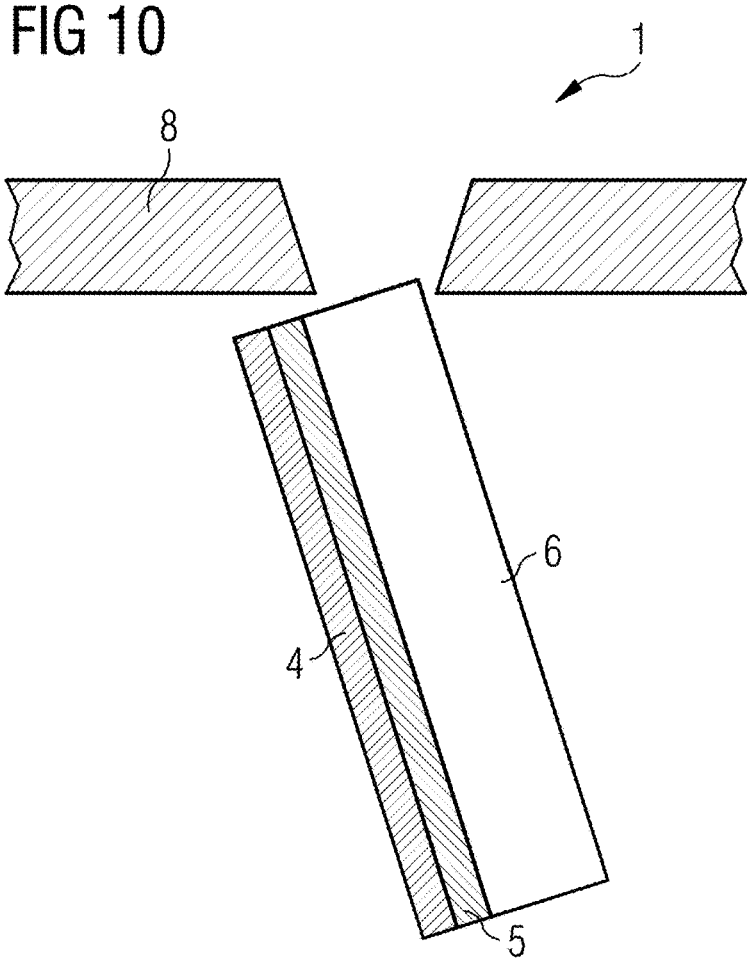
FIG. 10 depicts a schematic view of part of an embodiment of an x-ray device.

FIG. 10 shows a schematic view of a part of a further embodiment of an x-ray device 1. FIG. 10 shows an anode 4, a converter 5, a transmission body 6, and a collimator 8. The configuration shown in FIG. 10 corresponds to the configuration shown in FIG. 6, except that in FIG. 10, the converter 5 is arranged between and in contact with the anode 4 and the transmission body 6.

The anodes shown in the preceding figures may include material suitable for producing x-ray radiation upon being impacted by high-energy electrons, for example electrons having an energy of 50 keV, such as tungsten, gold, or the like. In order to configure an anode to produce x-ray radiation in transmission, the anode may include a thin layer of such a material, including, for example, a thickness between 5 μm (micrometers) and 25 μm (micrometers). Other thicknesses are also possible.

The converters shown in the preceding figures may include materials suitable for converting x-ray radiation, for example x-ray radiation produced by bremsstrahlung, into monochromatic x-ray radiation, like silver, gallium-oxide, or the like. The converter may include thin layers of such materials, in particular in the embodiments where the converter is embedded in the transmission body. Such layers may be as thin as for example 5 μm (micrometers) or 10 μm (micrometers) and may be as thick as for example 25 μm (micrometers) or 100 μm (micrometers). Other thicknesses are also possible.

The transmission bodies shown in the preceding figures may include materials which are transparent to x-ray radiation, in particular to x-ray radiation above the absorption edge of the converter, and also possess high heat capacitance and heat conduction. Examples for such materials include copper, carbon, silicon-carbide, and the like.

Even though not shown in the preceding figures, any embodiment may further include a cooling device for the anode, the converter and/or the transmission body. One cooling device may be provided for all of these or for a plurality thereof, or one cooling device may be provided for each of these. Such cooling devices may include water cooling or air-convection cooling.

Figure 11:
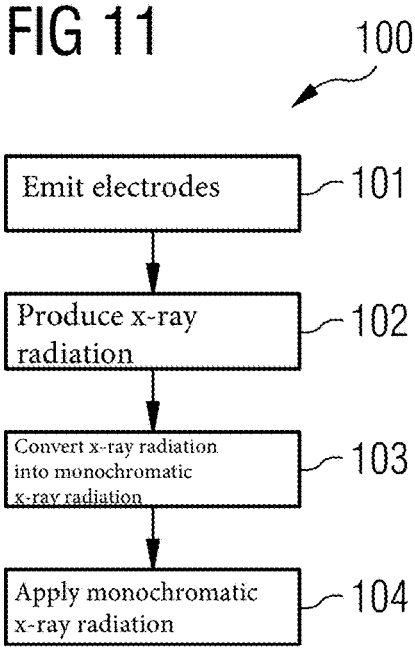
FIG. 11 depicts a schematic flow chart of an embodiment of a method of applying x-ray radiation.

FIG. 11 shows a schematic flow chart of a method 100 of applying x-ray radiation. In a method act 101, electrons are emitted by a cathode. The electrons are accelerated away from the electron and impact on an anode, thereby producing x-ray radiation in a further method act 102. The x-ray radiation produced in method act 102 is then converted into monochromatic x-ray radiation with a converter in a further method act 103. The monochromatic x-ray radiation is then applied in a further method act 104.

Although the disclosure was illustrated and described in more detail by the exemplary embodiments, the disclosure is not restricted by the disclosed examples and other variations may be derived herefrom by the person skilled in the art without departing from the scope of protection of the disclosure. It is therefore intended that the foregoing description be regarded as illustrative rather than limiting, and that it be understood that all equivalents and/or combinations of embodiments are intended to be included in this description.

It is to be understood that the elements and features recited in the appended claims may be combined in different ways to produce new claims that likewise fall within the scope of the present disclosure. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

The invention claimed is:

1. An x-ray device comprising:

a housing configured to provide a vacuum therein;

a cathode arranged inside the housing and configured to emit electrons;

an anode arranged inside the housing and configured to produce x-ray radiation when impacted by electrons emitted by the cathode;

a transmission body having a material transparent to x-ray radiation; and a converter arranged inside the transmission body, wherein the converter is configured to convert the x-ray radiation produced by the anode into monochromatic x-ray radiation, wherein the anode is configured to produce the x-ray radiation in transmission and is arranged between the cathode and the converter, and wherein the converter is arranged in a curved form such that at least one lateral edge of the converter is in contact with the anode.

2. The x-ray device of claim 1, further comprising:

a cooling device configured to cool the transmission body.

3. The x-ray device of claim 2, wherein the cooling device is further configured to cool the anode.

4. The x-ray device of claim 1, further comprising:

a cooling device configured to cool the anode.

5. The x-ray device of claim 1, further comprising:

a cooling device configured to cool the converter.

6. The x-ray device of claim 5, wherein the cooling device is further configured to cool the anode.

7. The x-ray device of claim 6, wherein the cooling device is further configured to cool the transmission body.

8. The x-ray device of claim 1, further comprising:

a heat conductor in contact with the converter or the transmission body.

9. The x-ray device of claim 1, wherein the transmission body is arranged between the anode and the converter in contact with the anode and the converter.

10. The x-ray device of claim 1, wherein the anode, the converter, and the transmission body are configured to rotate together around an axis of rotation to adjust which parts of the anode, the converter, and the transmission body are heated during use of the x-ray device.

11. The x-ray device of claim 10, further comprising:

a heat conductor in contact with the converter or the transmission body.

12. The x-ray device of claim 11, wherein the heat conductor is configured to rotate around the axis of rotation with the anode, the converter, and the transmission body.

13. The x-ray device of claim 1, wherein the transmission body is arranged in contact with the anode.

14. The x-ray device of claim 13, wherein the transmission body is arranged structurally separated from the converter.

15. The x-ray device of claim 13, wherein the transmission body is arranged in contact with the converter.

16. A method of applying x-ray radiation by an x-ray device, the method comprising:

emitting electrons from a cathode of the x-ray device;

producing x-ray radiation with an anode of the x-ray device being impacted by the electrons emitted from the cathode;

converting the x-ray radiation produced by the anode into monochromatic x-ray radiation with a converter of the x-ray device, wherein the converter is arranged inside a transmission body having a material transparent to the x-ray radiation;

applying the monochromatic x-ray radiation; and wherein the anode produces the x-ray radiation in transmission and is arranged between the cathode and the converter, and wherein the converter is arranged in a curved form such that at least one lateral edge of the converter is in contact with the anode.

* * * * *